US005242222A

United States Patent [19]

Michael

[11] Patent Number: 5,242,222

[45] Date of Patent: Sep. 7, 1993

[54] CHANNEL-STOP ASSEMBLY

[75] Inventor: Daryl A. Michael, Newton, Iowa

[73] Assignee: Maytag Corporation, Newton, Iowa

[21] Appl. No.: 844,844

[22] Filed: Mar. 2, 1992

[51] Int. Cl.[5] ..... A47B 88/00

[52] U.S. Cl. ..... 312/334.45; 312/334.46; 312/228.1; 16/95 R

[58] Field of Search ..... 312/228.1, 311, 334.44, 312/334.45, 334.46, 334.47; 16/94 R, 95 R; 384/21, 18, 19

[56] References Cited

U.S. PATENT DOCUMENTS 3,347,613 10/1967 Krzewina .
3,472,573 10/1969 Geiger .
3,982,802 9/1976 Bailey .
4,097,098 6/1978 Fields .
4,437,715 3/1984 Jenkins .
4,934,023 6/1990 Schubring ..... 16/95 R
5,061,020 10/1991 Ulrich .

*Primary Examiner*—Kenneth J. Dorner
*Assistant Examiner*—Brian K. Green
*Attorney, Agent, or Firm*—Zarley, McKee, Thomte, Voorhees, & Sease

[57] ABSTRACT

A channel-stop assembly includes an elongated C-shaped channel 26 having an aperture 76 adjacent one end thereof. Inserted in the channel is a channel-stop 40 having first and second body members 42, 44 which are hinged together. One of the body members is slidably fitted into the end of the channel, and the other body member is pivotal to a coupled position wherein a tab 72 on the second body member 44 protrudes within the aperture in the channel to prevent removal of the channel-stop from the end of the channel. The two body members can be uncoupled for removal of the tab from the channel aperture so that the channel-stop can be removed from the channel.

17 Claims, 3 Drawing Sheets

CHANNEL-STOP ASSEMBLY

BACKGROUND OF THE INVENTION

This invention relates to a channel-stop assembly, and particularly to a channel-stop assembly which can be utilized in a dishwasher.

Dishwashers often include a pair of spaced apart C-channels providing tracks for receiving the wheels of a dishwasher rack mounted within the dishwasher. These C-channels are open at their opposite ends, and removable channel-stops are provided in the opposite ends of the channels for preventing the rollers of the dish rack from rolling out of the C-channels.

In order to remove the rack from the dishwasher, it is necessary to remove the channel-stops from the ends of the C-channels so that the wheels of the rack may be rolled out of the ends of the channels.

Channel-stops have been provided in prior art devices, but these channel-stops are often difficult to remove.

SUMMARY OF THE INVENTION

Therefore a primary object of the present invention is the provision of an improved channel-stop assembly which can be quickly and easily removed from the channel so as to permit removal of a dishwasher rack from the dishwasher.

A further object of the present invention is the provision of an improved channel-stop assembly which provides a positive reliable stop at the end of the channel so as to prevent the rollers of the dishwasher rack from rolling out of the ends of the channel.

A further object of the present invention is the provision of a channel-stop assembly having a channel-stop formed out of plastic and being unitary in construction.

A further object of the present invention is the provision of a channel-stop assembly which is simple in construction, reliable in use, and efficient in operation.

The above objects are provided by an improved channel-stop assembly which is adapted for use with a dishwasher having a dishwasher tub with sidewalls. A pair of elongated channels are mounted to the sidewalls and each have a C-shaped cross-sectional configuration formed by a vertical web portion, an upper flange portion, and a lower flange portion. Adjacent each of the opposite ends of the channels is an aperture extending through the channel web portion.

Inserted within each of the opposite ends of the channels is a channel-stop which is comprised of a first body member and a second body member. The first body member includes a shank portion adapted to be slidably inserted into the end of the channel, and a head portion which abuts against the end of the channel when the shank is inserted. The head portion of the first body member includes a coupling notch adapted to receive a male coupling member on the second body member.

The second body member includes a male coupling member adapted to retentively and removably fit within the coupling notch of the first body member. The second body member also includes a protuberance or tab thereon. The second body member is movable from an uncoupled position to a coupled position wherein the male coupling member of the second body member retentively engages the coupling notch of the first body member, and wherein the protuberance or tab of the second body member protrudes within the aperture of the channel.

In operation or use of the channel-stop, the two body members are in their uncoupled position. The shank portion of the first body member is inserted into the end of the channel, and the second body member is moved to its coupled position so that the protuberance or tab on the second body member protrudes within the aperture in the channel. This prevents removal of the channel-stop from the channel due to the tab of the second body member protruding into the channel aperture.

When it is desired to remove the stop from the channel, the second body member is moved from its coupled position so as to remove the protuberance or tab from the aperture of the channel, thereby permitting the first body member to be slidably removed from the end of the channel.

DETAILED DESCRIPTION OF THE PREFERRED EMBODIMENT

Figure 1:
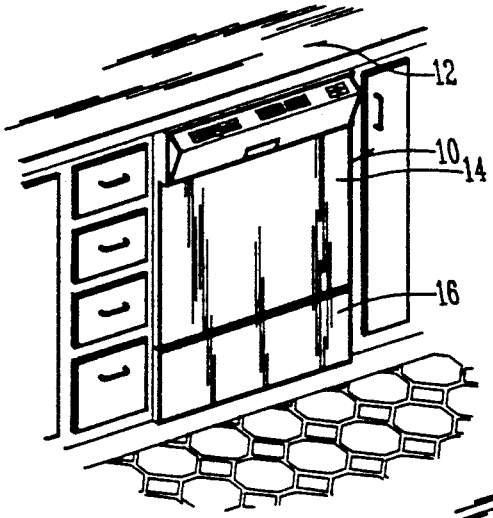
FIG. 1 is a perspective view of a dishwasher mounted beneath a counter in a kitchen.
Figure 2:
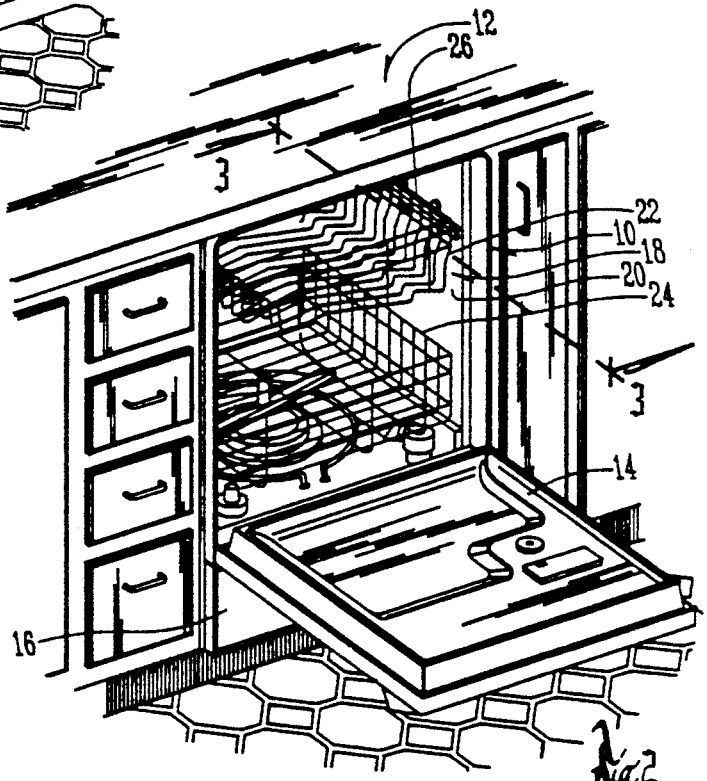
FIG. 2 is an enlarged view similar to FIG. 1, but showing the door of the dishwasher open.

Referring to the drawings, the numeral 10 generally refers to a dishwasher which is mounted beneath a counter 12 and which includes a door 14 and a lower access panel 16. The door 14 is hinged at its bottom and is movable to the position shown in FIG. 2 so as to expose a tub chamber 18 having opposite sidewalls 20, and including an upper dish rack 22 and a lower dish rack 24.

Mounted to the sidewalls 20 of the tub are a pair of C-shaped rack channels 26 which are held to the sidewalls 20 by means of a pair of spaced apart upper guide channel rollers 28 and a pair of lower guide channel rollers 30. Rollers 28, 30 are rotatably mounted to sidewalls 20 of dishwasher 10, and guide the channels 26 therebetween so that channels 26 can move longitudinally inwardly and outwardly to permit rack 22 to be pulled outwardly from dishwasher tub chamber 18.

Figure 3:
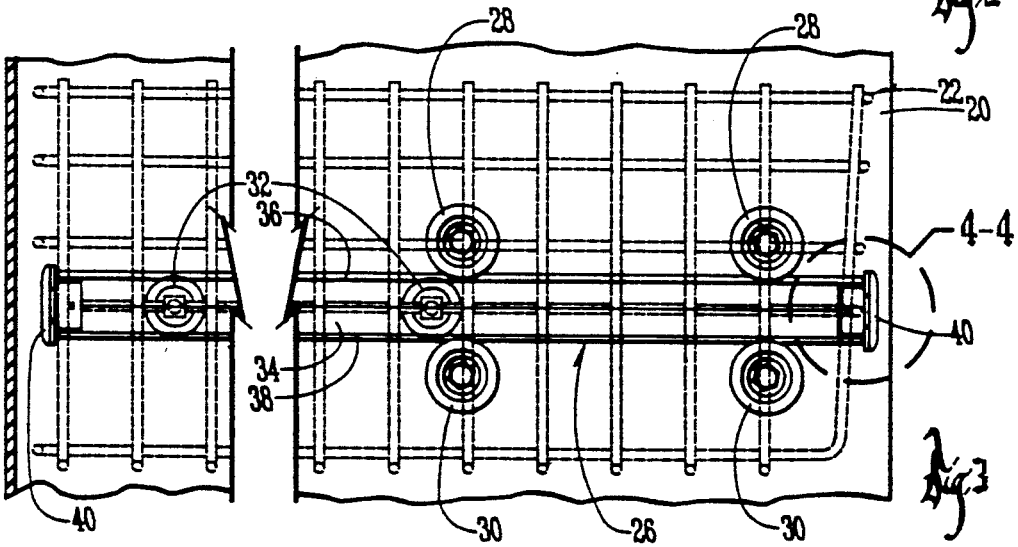
FIG. 3 is an enlarged detail view of the mounting of the channel to the sidewall of the dishwasher tub.
Figure 4:
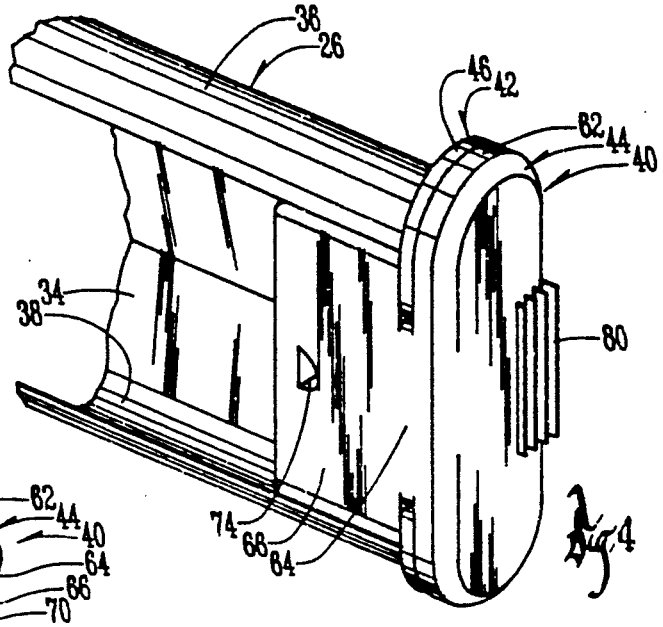
FIG. 4 is an enlarged perspective view of the end of one of the channels showing the channel-stop mounted therein.

Rack 22 also includes a plurality of rack rollers 32 which are rotatably mounted within rack channels 26 as can be seen in FIG. 3.

Each rack channel 26 in cross-section includes a vertical web 34, an upper C-flange 36, and a lower C-flange 38 which house the rack rollers 32 and permit longitudinal sliding movement of the rack rollers 32 within the channel 26.

Figure 8:
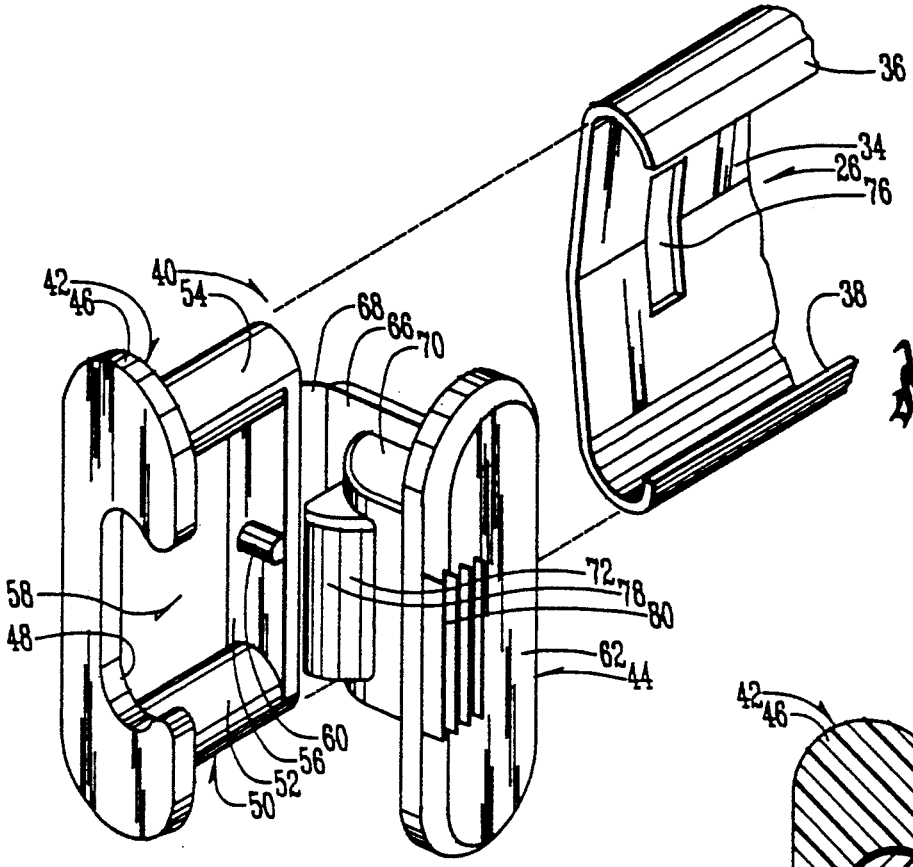
FIG. 8 is an enlarged perspective view of the channel-stop of the present invention showing its relationship to the channel prior to insertion.
Figure 10:
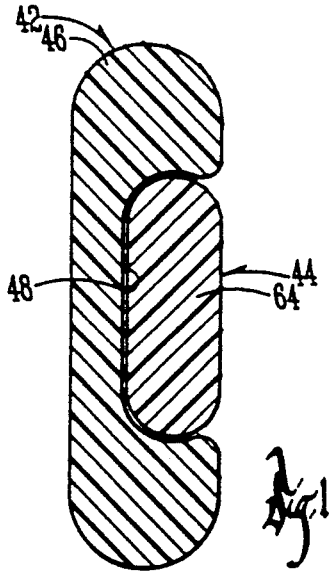
FIG. 10 is a sectional view taken along line 10—10 of FIG. 7.
Figure 9:
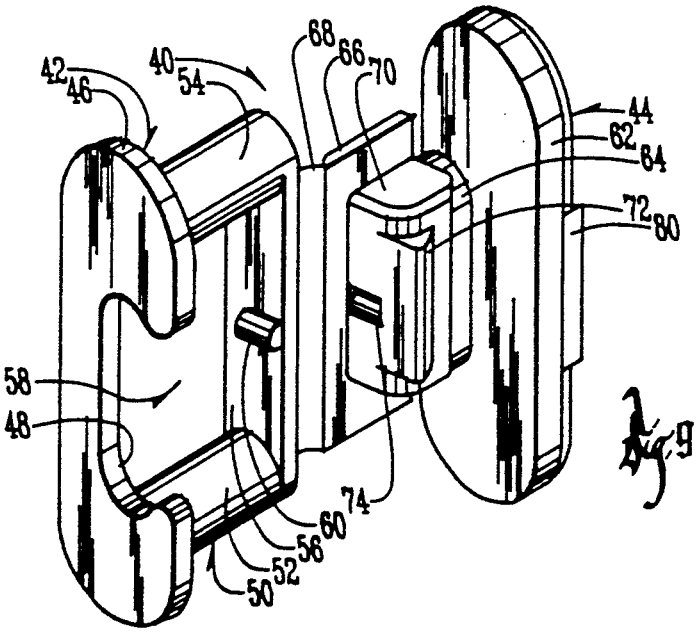
FIG. 9 is a perspective view of the channel-stop showing the first and second body members of the channel-stop in a position slightly different from that shown in FIG. 8.

Mounted within the ends of each of the channels 26 are channel-stops 40. Each channel-stop 40 is comprised of a first body member 42 and a second body member 44. As can be seen in FIGS. 8 and 9, the first body member 42 comprises a head flange 46 which has a C-shaped coupling notch 48 therein. Extending from head flange 46 is a shank portion 50 which is comprised of a lower shank leg 52, an upper shank leg 54, and a vertical connecting member 56 which form a central space 58 therebetween. Connecting member 56 includes a rib 60 projecting outwardly therefrom.

Second body member 44 includes a head flange 62 having a male coupling lug 64 (FIG. 9) extending therefrom and connected to a plate 66. In the preferred embodiment, plate 66 of second body member 44 is attached to connecting member 56 of first body member 42 by means of a hinge 68 which is a living hinge. By living hinge is meant that the entire channel-stop 40 is constructed of one piece, with the hinge 68 being flexible so as to permit hinged movement of the first body member 42 with respect to the second body member 44.

Protruding from plate 66 is a filler body 70 which is adapted to fit within the space 58 of first body member 42 and which includes a protrusion or tab 72 projecting therefrom. Filler body 70 also includes a groove 74 which is adapted to receive rib 60 when the two body members 42, 44 are hinged together.

Rack channels 26 each include adjacent their opposite ends a locking aperture or channel aperture 76. This channel aperture 76 is adapted to receive the protrusion or tab 72 of the second body member 44 as shown in FIG. 6. In FIG. 6 the first and second body members 42, 44 are shown in their coupled position with tab 72 protruding into the aperture 76, thereby preventing the removal of the channel-stop 40 from the end of channel 26. Tab 72 includes a curved surface 78 which permits tab 72 to move in and out of aperture 76 when the second body member 44 pivots into and out of coupled engagement with the first body member 42. The uncoupling of the first and second body members 42, 44 can be accomplished by pressing on the thumb shoulder 80 of second body member 44 so as to force the male coupling lug 64 outwardly from the coupling notch 48 of first body member 42. This permits the second body member 44 to be pivoted in a clockwise direction from the position shown in FIG. 6 to the position shown in FIG. 5, and permits the sliding removal of the first body member 42 from the end of channel 26.

Figure 5:
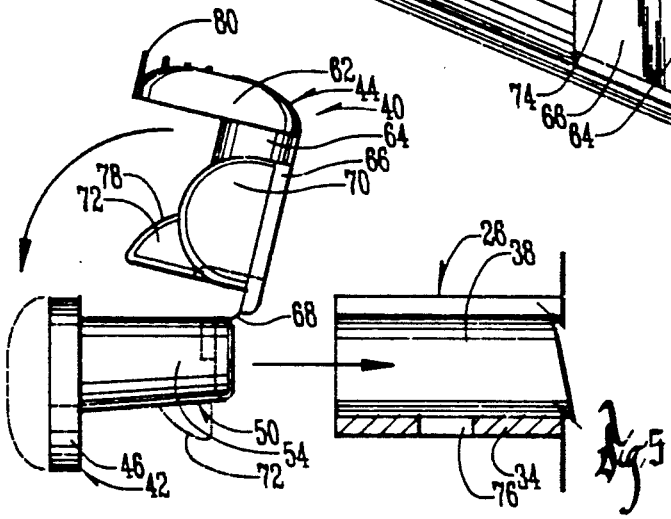
FIG. 5 is an enlarged detail view of the channel-stop in its uncoupled position before insertion into the end of a channel.
Figure 6:
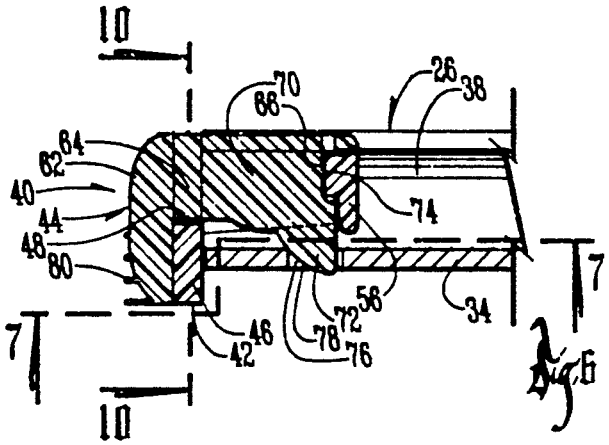
FIG. 6 is a view similar to FIG. 5, but showing the channel-stop in section in its coupled position within the end of the channel.
Figure 7:
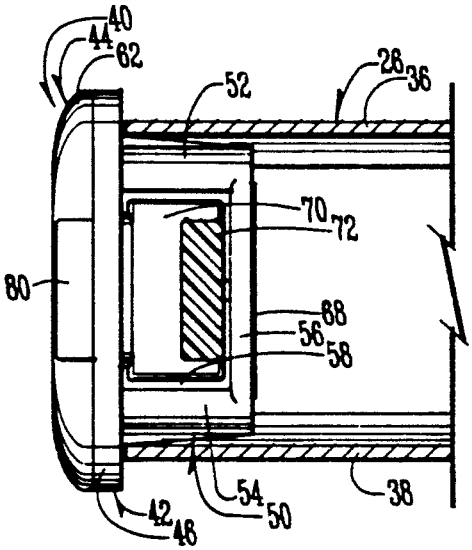
FIG. 7 is a sectional view taken along line 7—7 of FIG. 6.

The lower and upper shank legs 52, 54 are each tapered slightly as can be shown in FIGS. 5 and 7 to facilitate the sliding of the shank portion 50 into the end of channel 26.

A channel-stop 40 is inserted into each of the opposite ends of the channels 26 so as to prevent the rack rollers 32 from passing out through the ends of the channels 26. The stops 40 also function to limit the outward rolling movement of the channels 26 beyond the point where the rear most stop 40 (FIG. 3) engages the upper channel guide rollers 28.

The channel-stops 40 can be quickly and easily inserted or removed as desired so as to permit the removal of the rack 22 from the dishwasher 10.

While the two body members 42, 44 are shown in the drawings to be hinged together, the channel-stop 40 will also function properly if the two body members 42, 44 are separate from one another as might occur if hinge 68 becomes broken or separated. The interlocking of rib 60 and groove 74 helps couple body members 42, 44 together even if they are not connected together by hinge 68.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

I claim:

1. A channel-stop assembly for a dishwasher having a dishwasher tub with sidewalls, comprising:

an elongated channel adapted to be mounted to one of said sidewalls of said tub, said channel having first and second opposite ends and having a C-shaped cross-sectional configuration with a vertical web portion, an upper flange portion, and a lower flange portion;

said channel having an aperture therein adjacent said first end thereof;

a channel-stop having a first body member and a second body member;

said first body member having a first coupling means and a shank portion, said shank portion being sized to fit within and slide longitudinally within said C-shaped cross-sectional configuration of said channel to position said shank portion within said channel;

said shank portion of said first body member comprising spaced apart first and second legs slidably embraced between said upper flange portion and said lower flange portion respectively of said channel when said shank portion is within said channel;

said second body member including a second coupling means and having a protuberance thereon;

said second body member being movable to a coupled position wherein said first and second coupling means retentively engage one another and wherein said protuberance of said second body member extends within said aperture of said channel and holds said first and second body members against longitudinal movement in said channel.

2. A channel-stop assembly according to claim 1 wherein said second body member is movable from said coupled position to an uncoupled position wherein said first and second coupling means are uncoupled from retentive engagement with one another and wherein said protuberance is removed from said aperture to permit said shank portion of said first body member to slide from within said channel.

3. A channel-stop assembly according to claim 1 wherein hinge means interconnect said first and second body members for hinged movement to said coupled position.

4. A channel-stop assembly according to claim 3 wherein said hinge means comprises a living hinge.

5. A channel-stop assembly according to claim 1 wherein an open space is positioned between said first and second legs, said protuberance moving through said open space at least when said second body member moves to said coupled position.

6. A channel-stop assembly according to claim 5 wherein said first and second legs each include an inner end, said inner ends being spaced apart from one another; a connecting member interconnecting said inner ends of said first and second legs.

7. A channel-stop assembly according to claim 6 wherein hinge means connect said connecting member of said first body member to said second body member for hinged movement between said first and second body members.

8. A channel-stop assembly according to claim 1 wherein one of said first and second coupling means comprise a female coupling member having a coupling opening therein and the other of said first and second coupling means comprise a male coupling member adapted to matingly fit within said coupling opening to couple said first and second body members.

9. A channel-stop assembly according to claim 8 wherein one of said first and second body members includes a locking rib and the other of said first and second body members includes a locking groove, said locking rib and said locking groove being in addition to said male and female coupling members, and said locking rib protruding within said locking groove when said first and second body members are in said coupled position.

10. A channel-stop assembly according to claim 9 wherein said first body member includes a head portion engaging said first end of said channel when said first body member is within said one channel.

11. A channel-stop assembly according to claim 1 wherein said first and second body members are integrally formed with one another.

12. A channel-stop assembly according to claim 1 wherein said first and second body members are comprised of plastic.

13. A channel-stop assembly according to claim 1 wherein said aperture is located in said vertical web portion of said channel.

14. An improved channel-stop assembly for a dishwasher having a dishwasher tub with sidewalls, comprising:

an elongated channel adapted to be mounted to one of said sidewalls of said tub, said channel having first and second opposite ends and having a C-shaped cross-sectional configuration with a vertical web portion, an upper flange portion and a lower flange portion;

said channel having an aperture therein adjacent said first end thereof;

a first body member having a shank portion sized to fit within and slide longitudinally within said channel from a removed position wherein said shank portion is outside said channel to an inserted position wherein said shank portion is within said channel and is slidably embraced between said upper flange portion and said lower flange portion;

means movably connecting said first body member to said second body member for movement when said shank portion of said first body member is within said channel in said inserted position from a first position wherein said protuberance is removed from said aperture to a second position wherein said protuberance is within said aperture and holds said first body member against longitudinal sliding movement within said channel.

15. A channel-stop assembly according to claim 14 wherein said first and second body members include first and second latch means respectively which retentively detachably engage one another when said first body member is in said inserted position.

16. A channel-stop assembly according to claim 15 wherein hinge means movably connect said first body member to said second body member for hinged movement of said second body member between said first and second positions.

17. In combination:

an elongated channel having first and second ends and including in cross-section a vertical web portion having upper and lower ends, an upper flange portion extending from said upper web end, and a lower flange portion extending from said lower web end, said vertical web portion and said upper and lower flange portions forming a C-shaped channel cross-section;

said channel having an aperture therein;

a channel-stop comprising a first body member and a second body member;

said first body member having a first coupling means and a shank portion, said shank portion engaging both of said upper and lower flange portions for longitudinal sliding movement within said channel;

said second body member including a second coupling means and having a protuberance thereon;

said second body member being movable to a coupled position wherein said first and second coupling means retentively engage one another and wherein said protuberance of said second body member extends within said aperture of said channel and holds said first and second body member against longitudinal movement in said channel.

* * * * *

UNITED STATES PATENT AND TRADEMARK OFFICE

CERTIFICATE OF CORRECTION

PATENT NO. : 5,242,222

DATED : September 7, 1993

INVENTOR(S) : Daryl A. Michael

It is certified that error appears in the above-identified patent and that said Letters Patent is hereby corrected as shown below:

| | |
|---|---|
| Col. 5, line 36 | after "said" delete -- one -- |
| Col. 6, line 10 | before "means" insert -- a second body member having a protuberance thereon; -- |
| Col. 6, line 52 | "member" should be -- members -- |

Signed and Sealed this

Twenty-eighth Day of June, 1994

Bruce Lehman

*Attest:*

BRUCE LEHMAN

*Attesting Officer*

*Commissioner of Patents and Trademarks*